United States Patent [19]

Bond

[11] 4,331,266

[45] May 25, 1982

[54] FINGER-ACTUATED SLIDEABLE-GATE DISPENSING VALVE

[75] Inventor: Curtis J. Bond, Marion, Ohio

[73] Assignee: Liqui-Box Corporation, Worthington, Ohio

[21] Appl. No.: 165,499

[22] Filed: Jul. 3, 1980

[51] Int. Cl.[3] ..... B67D 5/60; B65D 47/00

[52] U.S. Cl. ..... 222/107; 220/345; 222/464; 222/561; 251/284

[58] Field of Search ..... 222/105, 107, 464, 559, 222/560, 561; 251/147, 284, 326, 329; 220/345

[56] References Cited

U.S. PATENT DOCUMENTS

| | | | |
|---|---|---|---|
| 2,058,830 | 10/1936 | Ruetz | 222/559 X |
| 2,265,154 | 12/1941 | Erb | 222/559 X |
| 2,370,997 | 3/1945 | Rudolph | 222/559 |
| 2,532,690 | 12/1950 | Zimmerman | 222/561 X |
| 2,715,485 | 8/1955 | Bernhardt | 222/559 X |
| 3,081,911 | 3/1963 | Scholle | 222/107 |
| 3,257,036 | 6/1966 | Micallef | 222/464 X |
| 3,420,413 | 1/1969 | Corsette | 222/107 |

*Primary Examiner*—Gil Weidenfeld
*Assistant Examiner*—Fred A. Silverberg
*Attorney, Agent, or Firm*—William V. Miller

[57] ABSTRACT

A dispensing valve comprising a gate slideable transversely over the outer end of a passage from which is to be dispensed various viscous substances. The gate is slideable substantially at a right angle to the axis of the passage and the gate slide and guide are curved transversely relative to the direction of sliding movement so that the gate will be pulled axially into sealing engagement with the outer end of the passage as it moves thereover. Reciprocation of the gate can be accomplished with the fingers of one hand due to the provision of the cooperating lug arrangement on the slide gate and guide.

8 Claims, 13 Drawing Figures

FINGER-ACTUATED SLIDEABLE-GATE DISPENSING VALVE

BACKGROUND OF THE INVENTION AND PRIOR ART

This invention deals with a valve used for controlling bulk dispensing of viscous substances such as sauces, salad dressings, catsup, mustard or various other substances, especially where it is desirable to have a valve that can be operated with one hand while the other hand, for example, is holding the receiving vessel, such as in fast-food restaurants, etc. These substances are commonly packaged in flexible bags or pouches which may or may not be contained in boxes. The prior art provides two main types of valves for this purpose. One is the rotatable cylindrical tube type which cannot be disassembled for cleaning, and this allows for residue accumulation, and cannot be tilted in dispensing so that all the contents of the bag is discharged. The other is the ball-type which also cannot be disassembled for cleaning and allows for residue accumulation.

SUMMARY OF INVENTION

The present invention provides a gate valve which is to be mounted on the spout of a bag or pouch. It includes a tubular sleeve adapted to be inserted into the spout of a bag and has a dispensing package extending therethrough. At the outlet end of this passage is a guide extending at a right angle to the axis thereof and this slide carries a receprocable gate. Cooperating lugs are provided on the gate and guide so that by engagement thereof with the fingers of one hand, the gate can be reciprocated to position it over the discharge or dispensing outlet. The gate and guide are curved complementally transversely so that the gate is drawn into sealing engagement with the outlet as it moves over it and an effective seal will result, however, when the gate is completely opened, there will be no obstruction to flow from the outlet but when it moves towards closed position variable flow will occur and ultimately complete cut-off.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
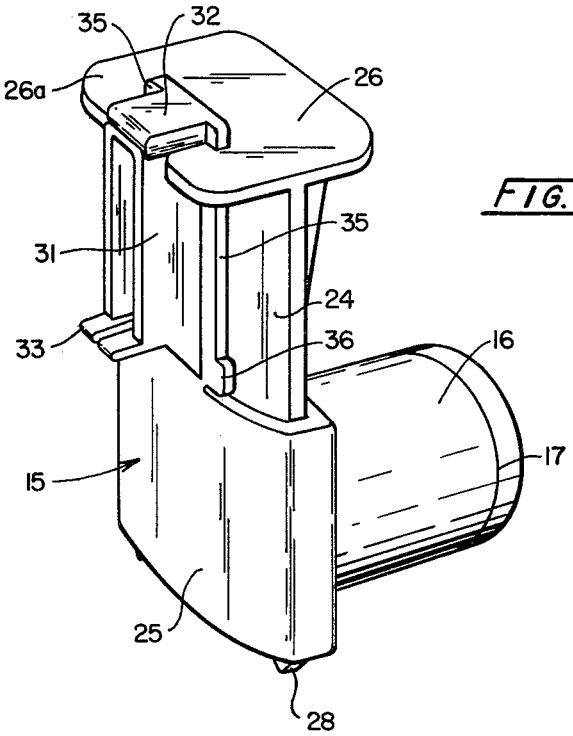
FIG. 1 is a perspective view of a valve embodying this invention.
Figure 2:
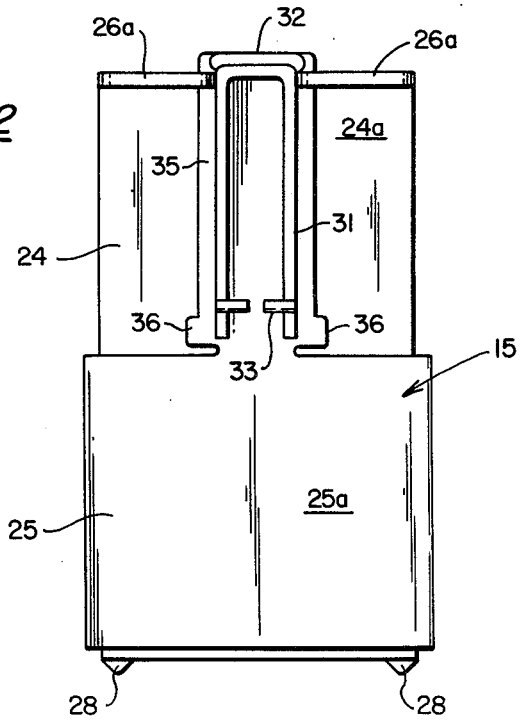
FIG. 2 is a front view of the valve with the gate closed.
Figure 3:
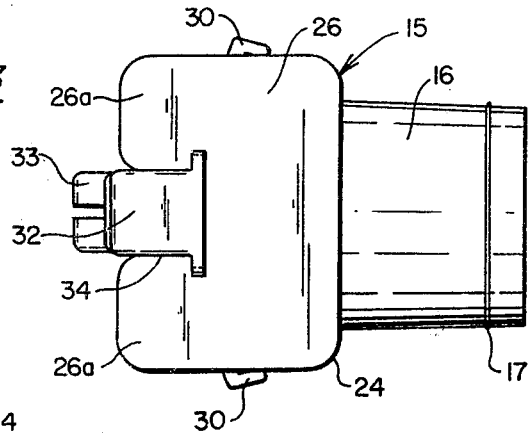
FIG. 3 is a plan view of the valve.
Figure 4:
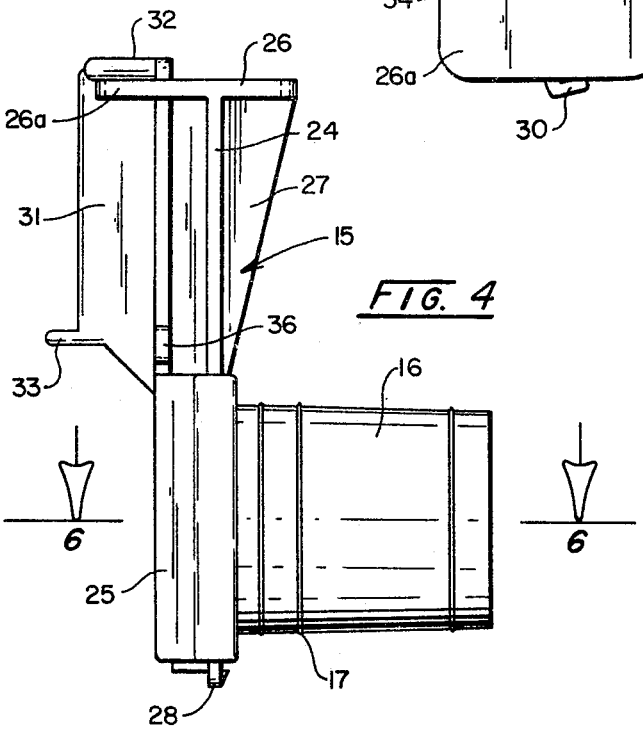
FIG. 4 is a side elevational view of the valve.
Figure 5:
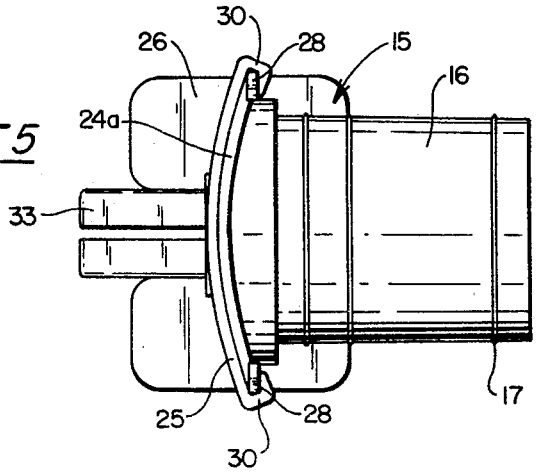
FIG. 5 is a bottom view of the valve.

With specific reference to the drawings, the valve assembly of this invention is illustrated generally by the numeral 15 and is shown removably mounted on the spout S of the bag B in FIGS. 9 to 13, the bag being disposed in the housing of a dispenser D of a common type. The bag may contain a viscous substance, such as salad dressing, sauce, mustard, catsup, etc. in bulk, which it is desired to dispense by using one hand only, having the other hand free, for example, to hold a receiving vessel.

The valve 15 itself comprises a spout insert mounting sleeve 16 which is slightly tapered so it will slip into and gradually tightly frictionally engage the interior of the spout S. It is provided with a plurality of axially-spaced annular sealing ribs 17 on its exterior surface for engaging the interior surface of the spout. It is further provided with a passage 18 extending axially therethrough having a discharge outlet with a substantially annular sealing edge extremity 20 extending therearound. The interior surface of the sleeve also has adjacent its inlet end 21 an annular stop shoulder 22. The annular outer or discharge edge 20 of the sleeve 16 is curved transversely relative to the axis of the sleeve in a manner and for a purpose to be described.

Figure 6:
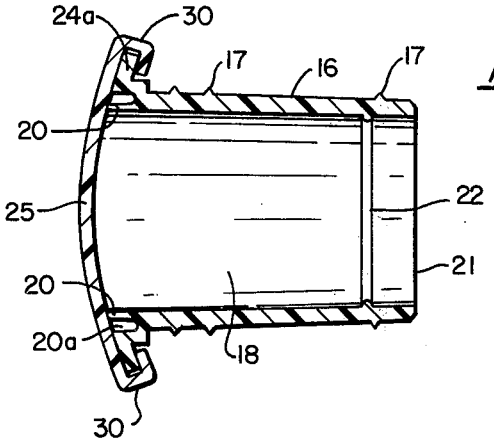
FIG. 6 is a sectional view taken along line 6—6 of FIG. 4.
Figure 7:
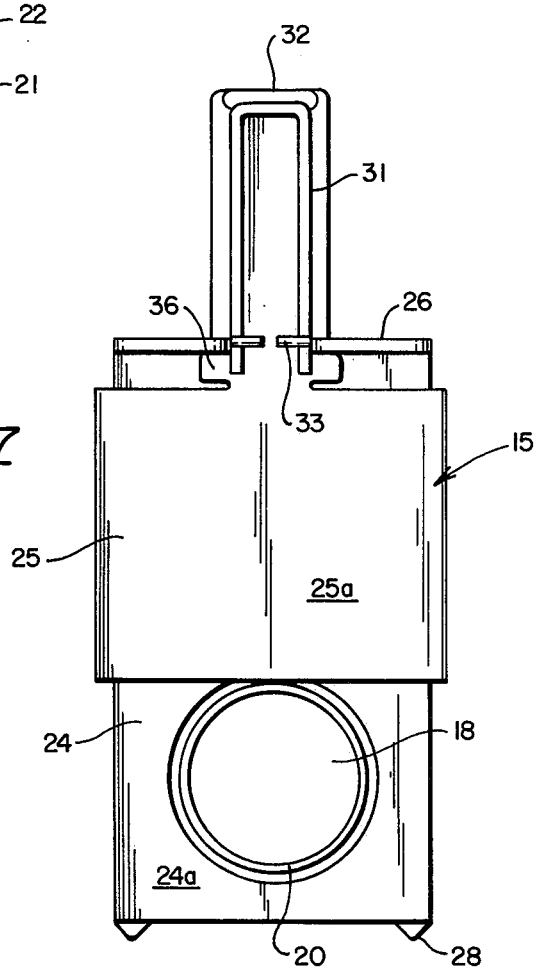
FIG. 7 is a view similar to FIG. 2 but with the gate opened.
Figure 8:
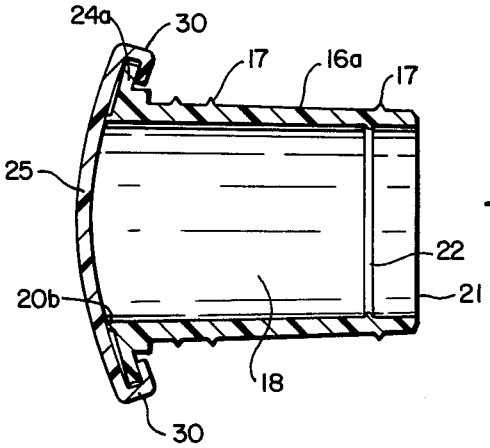
FIG. 8 is a view similar to FIG. 6 but showing a different sealing lip around the discharge outlet.
Figure 9:
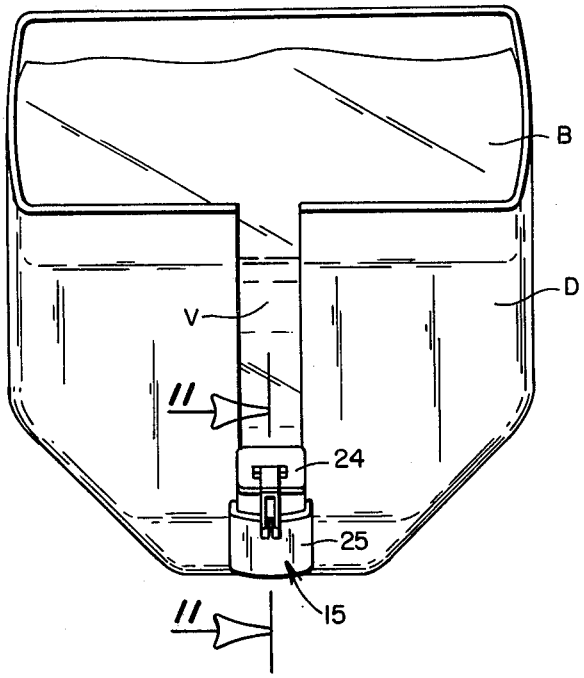
FIG. 9 is a top plan view showing the valve on the spout of a bag which is supported in a dispenser.
Figure 10:
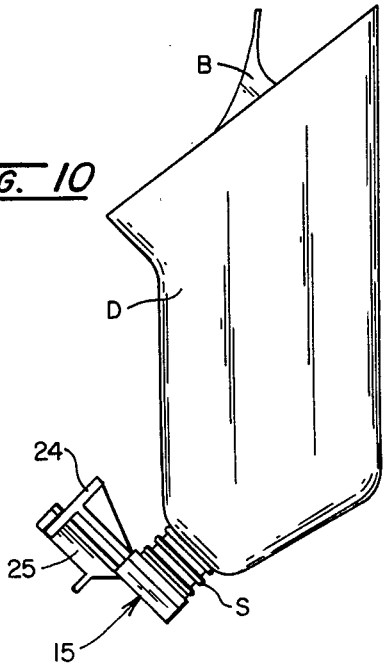
FIG. 10 is a side elevational view of the assembly shown in FIG. 9.
Figure 11:
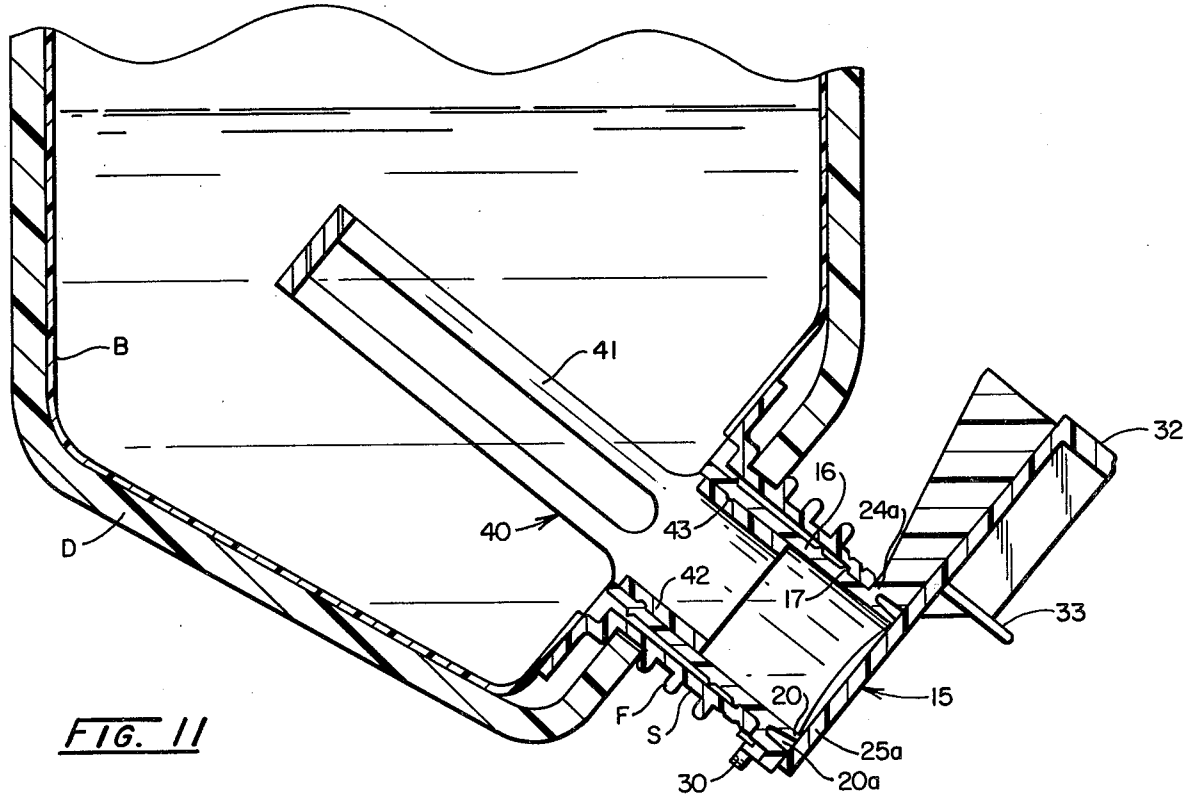
FIG. 11 is an enlarged sectional view of the bag spout and valve carried thereby in the dispenser.

At the outer or discharge end of the sleeve 16, a gate valve guide member 24 is formed integral with the sleeve and extends radially outwardly from the sleeve. It will be disposed to guide the gate valve member 25 during its reciprocal movement relative to the discharge or dispensing outlet 20 of the sleeve. The guide member 24 is in the form of a transversely-curved plate **24*a* which is formed integrally with and disposed in radially-extending relationship to the sleeve 16 at the outer or discharge end thereof. Assuming the valve assembly is in the position shown in the drawings, the guide 24 will be upstanding from the sleeve 16 with the vertical centerline thereof disposed at a right angle to the axis of the sleeve 16. The curve of the guide plate 24*a* will be transverse of the centerline thereof, and the axis of the sleeve 16 will be radial relative to that curvature. It will be noted that the guide plate 24*a* will extend down below the outlet opening and that the sealing edge 20 will be substantially flush with the adjacent outer or front surface thereof. A sharp sealing edge 20 is formed by providing the surrounding groove 20*a* where the end of the sleeve 16 joins the guide plate 24*a*. The structure of FIG. 8 is the same as that shown in FIG. 6 except that there is a sharp sealing lip extremity 20*b* which extends slightly beyond the surrounding face of the guide plate 24*a*. The guide 24 is provided at its end opposite the sleeve 16, or its upper end, with a transverse wall or lug 26 which is reinforced by a gusset 27. Rearwardly-projecting resiliently yieldable stop lugs 28 are provided on the lower edge and at each side of the guide plate 24*a***.

The gate valve member 25 itself comprises a plate **25*a* which is curved transversely complementally to the curvature of the guide plate 24*a*. This plate has, at each of its straight side edges, flanges of channel-formations which produce opposed guide-receiving formations 30 that provide inwardly-opening grooves for receiving the opposite side edges of the guide plate 24***a*. The guide channels 30 will be precisely fitted onto the edges of the plate 24*a* so as to draw the transversely curved gate plate 25*a* tightly into engagement with the complementally transversely curved guide plate 24*a*.

The gate valve member 25 is reciprocated on the guide member 24 relative to the sleeve 16 by means of an integral upward guide and operating channel-like extension 31 extending upwardly from the gate plate 25*a*. This extension 31 will be disposed at the center-line of gate plate 25*a* and guide plate 24*a* and radially of the discharge outlet of the sleeve 16. It is formed so as to have a flat-finger lug 32 at its upper or outer end and a similar but split lug 33 at its inner or lower end. The extension 31 has opposed side guide flanges 35 which slideably fit in an undercut guide slot 34 in the wall 26 for vertical or radial reciprocation. It will be noted that this slot 34 produces a pair of lugs 26*a* on wall member 26 at its opposite forward corners. Below the lug 33, on the guide flanges 35, laterally-projecting stop lugs 36 are provided for engagement with the inner or undersurfaces of lugs 26*a* to limit upward or outward movement of gate valve member 25 on guide member 24. Lower movement normally is limited by stop lugs 28, which extend inwardly over the ends of guide channels 30, when they move into engagement therewith. However, sufficient downward force on the gate valve member 25 will cause the resilient lugs 28 to yield and permit member 25 to move off member 24. Thus, disassembly is possible for cleaning and reassembly is simple by a reversal of this procedure.

An example of a use of the gate assembly 15 is in the dispenser D of FIGS. 9 to 13. The housing thereof receives a bag B with a valve assembly 15 mounted on the spouts thereof. The housing has a vertical slot V which receives the spout S of the bag and will cooperate with flanges F on the spout to lock it and the valve assembly 15 carried thereby, in downwardly-inclined position so that all the contents will flow from the bag B.

To mount the valve assembly on the spout S, it is merely necessary to guide the tapered sleeve 16 thereof into the spout until the outer edge of the spout (FIG. 11) is engaged by the guide plate 24*a*. The interior surfaces of the spout will frictionally seal with the adjacent exterior surface of the sleeve 16 and at least one of the sealing ribs 17 will be engaged. In some instances, it is desirable to use an extension 40 on the spouts, as shown best in FIG. 11, to prevent the collapse of the bag B around the inlet end thereof and this can be carried by the valve assembly 15. It is shown as comprising a slotted tube 41 which has a collar 42 at its inner end that is complemental in taper to the interior taper of the bore 18 of the insert sleeve 16 of the valve. On its exterior surface, collar 42 is provided with locking groove 43 which receives the locking rib 22 of the sleeve 16 to lock the collar 42 and sleeve 16 together.

Figure 12:
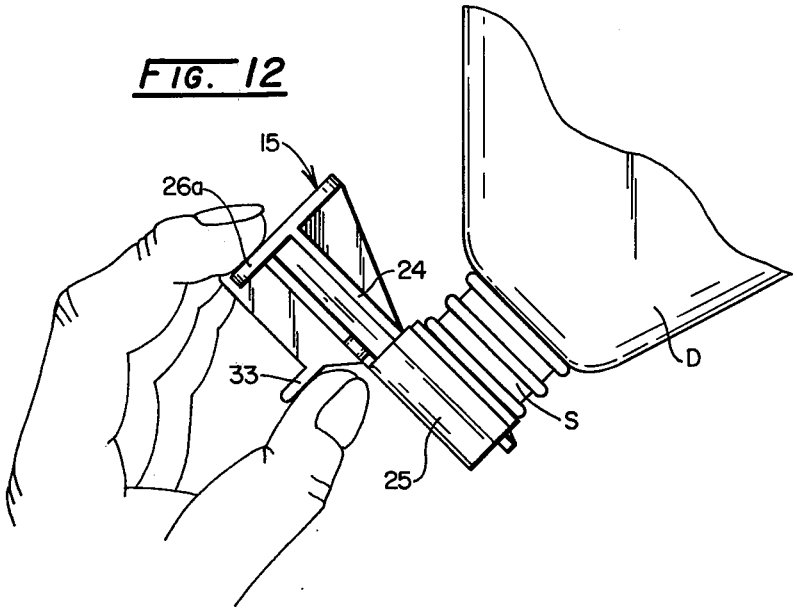
FIG. 12 is a schematic view showing how the fingers are used in opening the valve.
Figure 13:
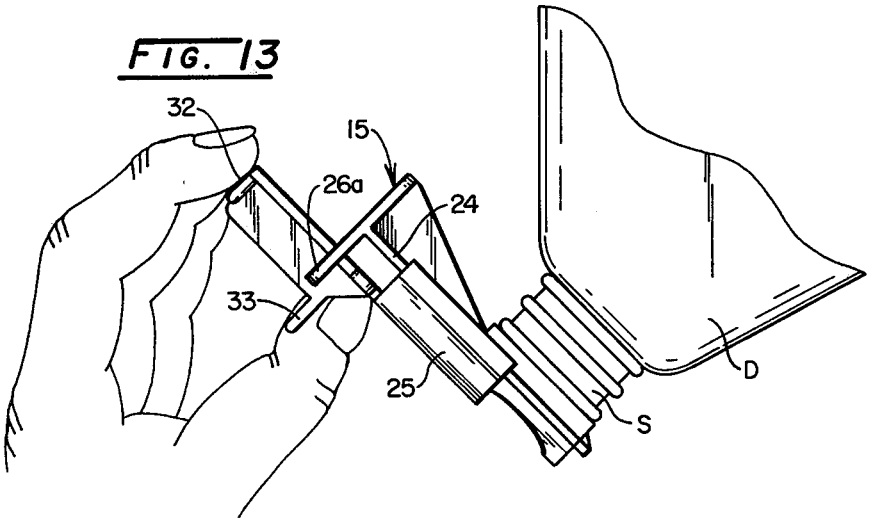
FIG. 13 is a similar view showing the closing of the valve.

The gate valve member 25 may be moved between opened and closed positions with the fingers of one hand. Assume it is closed as shown in FIG. 12, the lugs 26*a* of guide member 24 may be engaged by the index finger and middle finger and the inner lug 33 of member 25 by the thumb. Then by exerting pressure, the gripped lugs will be moved together, thereby moving gate 25 radially outwardly on guide 24 and exposing the outlet end of dispensing passage 18. Now if the gate valve member 25 is to be closed, the thumb is engaged with one of the lugs 26*a* of guide 24 and the index finger is engaged with the lug 32 on the outer end of member 25. Then by exerting pressure, the gripped lugs will be moved together and the valve member 25 will be moved radially-inwardly into closed position.

The movement of the gate can be gradual from opened to closed positions or can be accomplished quickly. The passage 18 will be completely unobstructed when the valve is opened. Complete cut-off will occur when the valve reaches closed position and there will be an effective seal. The valve can function when the valve assembly is in inclined position and, thus, will function when a bag carrying the valve assembly is mounted in a dispenser of the type indicated. The valve can be actuated with one hand only. It can be readily disassembled for cleaning and can be easily reassembled.

Having thus described this invention what is claimed is:

1. A gate dispensing valve assembly comprising a tubular mounting sleeve having a dispensing passage extending therethrough with an inlet end and outlet end, a guide at the outlet and extending radially at a right angle to the axis of the sleeve, and a gate mounted on the guide for reciprocable movement thereon from a closed position, in covering relationship to said outlet end, to an opened position radial of said end to expose an outlet opening at said end, said gate being curved transversely relatively to the direction of movement thereof and said guide being complementally curved transversely, and guide connections between the gate and guide to permit relative sliding for said reciprocable movement of the gate between closed and opened positions, said guide being in the form of a plate extending radially of the sleeve and the sleeve having its outlet opening at the plate, said gate being in the form of a plate, both plates being in close slideable contact, said guide connections comprising channel guides on side edges of the gate plate which slideably receive side edges of the guide plate; means for sliding the gate plate on the guide plate by gripping with the fingers, said means comprising a radial extension on the gate plate having radially-spaced inner and outer finger lugs, and said guide plate having a guide and finger lug through which said extension slideably projects and which is located with said outer lug adjacent the guide and finger lug when the gate plate is in the closed position but with the inner finger lug adjacent the guide and finger lug when the inner lug is squeezed towards the guide and finger lug by fingers engaging the guide and finger lug and said inner lug to move said valve plate to the opened position, said outer lug and said guide and finger lug being engageable by fingers to move said valve plate to the closed position.

2. A valve assembly according to claim 1 in which a sealing lip on the guide plate surrounds the outlet opening and is engaged by the gate plate.

3. A valve assembly according to claim 2 in which the sealing lip is flush with the guide plate surface.

4. A valve assembly according to claim 2 in which the sealing lip projects from the guide plate surface.

5. A valve assembly according to claim 1 in which the sleeve is adapted to fit and seal within a spout or the like on a flexible bag, and an extension carried by the sleeve for projecting axially-inwardly into the bag to prevent collapsing of the bag around the inlet end of the sleeve, and extension being carried by a collar which fits axially into the sleeve.

6. A valve assembly according to claim 1 in which said guide and finger lug on the guide plate has an undercut guide slot for slideably receiving the radial extension and guide flanges thereon, said flanges carrying stop projections inwardly of the inner finger lug thereon for engaging said guide and finger lug on the guide plate as the gate plate is moved into the opened position, and resilient lugs at the end of the guide plate which will extend over the channel guides of the gate plate and engage them as the gate plate reaches the valve-closing position.

7. A gate dispensing valve assembly comprising a tubular mounting sleeve having a dispensing passage extending therethrough with an inlet end and outlet end, a guide at the outlet end extending radially at a right angle to the axis of the sleeve, and a gate mounted on the guide for reciprocable movement thereon from a closed position, in covering relationship to said outlet end, to an opened position radial of said end to expose an outlet opening at said end, said gate being curved transversely relatively to the direction of movement thereof and said guide being complementally curved transversely, and guide connections between the gate and guide to permit relative sliding for said reciprocable movement of the gate between closed and opened positions; said guide being in the form of a plate extending radially of the sleeve and the sleeve having its outlet opening at the plate, said gate being in the form of a plate, both plates being curved complementally transversely to lie in close slideable contact, said guide connections comprising channel guides on side edges of the gate plate which slideably receive side edges of the guide plate; means for sliding the gate plate on the guide plate by gripping with the fingers, said means comprising a radial extension on the gate plate having radially-spaced inner and outer finger lugs, and said guide plate having a guide and finger lug through which said extension slideably projects, said extension carrying stop projections inwardly of the inner finger lug for engaging the guide and finger lug on the guide plate to stop radial movement of the gate plate on the guide plate as the gate plate reaches valve-opening position.

8. A valve assembly according to claim 7 including resilient lugs at the end of the guide plate on its side edges which will extend over the channel guides of the gate plate and engage them as the gate plate reaches valve-closing position.

* * * * *